US006488812B2

(12) United States Patent
Shannon et al.

(10) Patent No.: US 6,488,812 B2
(45) Date of Patent: Dec. 3, 2002

(54) SOFT TISSUE WITH IMPROVED LINT AND SLOUGH PROPERTIES

(75) Inventors: Thomas Gerard Shannon, Neenah, WI (US); Mike Thomas Goulet, Neenah, WI (US); Fu Chen, Westchester, PA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/736,924

(22) Filed: Dec. 14, 2000

(65) Prior Publication Data

US 2002/0112834 A1 Aug. 22, 2002

(51) Int. Cl.[7] ..... D21H 17/34; D21H 17/45

(52) U.S. Cl. ..... 162/164.6; 162/166; 162/168.3; 162/179

(58) Field of Search ..... 162/109, 111, 162/112, 127, 158, 164.1, 166, 167, 168.1, 168.2, 168.3, 168.4, 168.5, 183; 210/732, 733, 734, 735; 510/515, 520; 428/152, 153, 154; 526/72, 303.1, 310, 315

(56) References Cited

U.S. PATENT DOCUMENTS

| | | | | | |
|---|---|---|---|---|---|
| 3,556,932 | A | | 1/1971 | Coscia et al. | 162/166 |
| 4,326,000 | A | | 4/1982 | Roberts, Jr. | 428/153 |
| 4,702,844 | A | * | 10/1987 | Flesher et al. | 210/733 |
| 5,085,736 | A | * | 2/1992 | Bjorkquist | 162/168.2 |
| 5,131,982 | A | * | 7/1992 | St. John | 162/168.2 |
| 5,234,547 | A | * | 8/1993 | Knight et al. | 162/111 |
| 5,320,711 | A | * | 6/1994 | Dauplaise et al. | 162/168.2 |
| 5,405,501 | A | * | 4/1995 | Phan et al. | 162/127 |
| 5,541,252 | A | | 7/1996 | Schmitt et al. | 524/555 |
| 5,607,551 | A | | 3/1997 | Farrington, Jr. et al. | 162/109 |
| 5,730,839 | A | * | 3/1998 | Wendt et al. | 162/111 |
| 5,954,921 | A | * | 9/1999 | Dahmen et al. | 162/168.2 |

FOREIGN PATENT DOCUMENTS

| | | |
|---|---|---|
| GB | 1372787 | 11/1974 |

* cited by examiner

*Primary Examiner*—Steven P. Griffin
*Assistant Examiner*—Eric Hug
(74) *Attorney, Agent, or Firm*—Gregory E. Croft

(57) ABSTRACT

A synthetic polymer having hydrogen bonding capability and containing a hydrophobic aliphatic hydrocarbon moiety can reduce lint and slough in soft tissue products while maintaining softness and strength.

59 Claims, 3 Drawing Sheets

SOFT TISSUE WITH IMPROVED LINT AND SLOUGH PROPERTIES

BACKGROUND OF THE INVENTION

In the manufacture of paper products, such as facial tissue, bath tissue, paper towels, dinner napkins and the like, a wide variety of product properties are imparted to the final product through the use of chemical additives applied in the wet end of the tissue making process. Two of the most important attributes imparted to tissue through the use of wet end chemical additives are strength and softness. Specifically for softness, a chemical debonding agent is normally used. Such debonding agents are typically quaternary ammonium compounds containing long chain alkyl groups. The cationic quaternary ammonium entity allows for the material to be retained on the cellulose via ionic bonding to anionic groups on the cellulose fibers. The long chain alkyl groups provide softness to the tissue sheet by disrupting fiber-to-fiber hydrogen bonds in the sheet. The use of such debonding agents is broadly taught in the art. Such disruption of fiber-to-fiber bonds provides a two-fold purpose in increasing the softness of the tissue. First, the reduction in hydrogen bonding produces a reduction in tensile strength thereby reducing the stiffness of the sheet. Secondly, the debonded fibers provide a surface nap to the tissue web enhancing the "fuzziness" of the tissue sheet. This sheet fuzziness may also be created through use of creping as well, where sufficient interfiber bonds are broken at the outer tissue surface to provide a plethora of free fiber ends on the tissue surface. Both debonding and creping increase levels of lint and slough in the product. Indeed, while softness increases, it is at the expense of an increase in lint and slough in the tissue relative to an untreated control. It can also be shown that in a blended (non-layered) sheet that the level of lint and slough is inversely proportional to the tensile strength of the sheet. Lint and slough can generally be defined as the tendency of the fibers in the paper web to be rubbed from the web when handled.

It is also broadly known in the art to use a multi-layered tissue structure to enhance the softness of the tissue sheet. In this embodiment, a thin layer of strong softwood fibers is used in the center layer to provide the necessary tensile strength for the product. The outer layers of such structures are composed of the shorter hardwood fibers, which may or may not contain a chemical debonder. A disadvantage to using layered structures is that while softness is increased the mechanism for such increase is believed due to an increase in the surface nap of the debonded, shorter fibers. As a consequence, such structures, while showing enhanced softness, do so with a trade-off in the level of lint and slough.

It is also broadly known in the art to concurrently add a chemical strength agent in the wet-end to counteract the negative effects of the debonding agents. In a blended sheet, the addition of such agents reduces lint and slough levels. However, such reduction is done at the expense of surface feel and overall softness and becomes primarily a function of sheet tensile strength. In a layered sheet, strength chemicals are added preferentially to the center layer. While this perhaps helps to give a sheet with an improved surface feel at a given tensile strength, such structures actually exhibit higher slough and lint at a given tensile strength, with the level of debonder in the outer layer being directly proportional to the increase in lint and slough.

There are additional disadvantages with using separate strength and softness chemical additives. Particularly relevant to lint and slough generation is the manner in which the softness additives distribute themselves upon the fibers. Bleached Kraft fibers typically contain only about 2–3 milli-equivalents of anionic carboxyl groups per 100 grams of fiber. When the cationic debonder is added to the fibers, even in a perfectly mixed system where the debonder will distribute in a true normal distribution, some portion of the fibers will be completely debonded. These fibers have very little affinity for other fibers in the web and therefore are easily lost from the surface when the web is subjected to an abrading force.

Therefore there is a need for a means of reducing lint and slough in soft tissues while maintaining softness and strength.

SUMMARY OF THE INVENTION

It has now been discovered that the amount of lint and slough can be reduced for a given tensile strength or level of debonder chemical. This is accomplished by incorporating into the paper sheet a synthetic polymer having a portion of its structure derived from the polymerization of acrylamide and thereby containing pendant amide groups capable of increasing interfiber bonding. The synthetic polymer also contains an aliphatic hydrocarbon moiety. While not wishing to be bound by theory, it is believed that the synthetic polymer eliminates the potential for formation of totally debonded fibers. The aliphatic hydrocarbon portion of the molecule enables a significant level of debonding to occur and insures that the product has good surface nap or "fuzzy" feel. Yet, these fibers retain a significant bonding potential due to the presence of the pendant bonding functionality and as such the fibers remain anchored to the web. As such, fibers treated with these synthetic polymers produce a tissue web having lower lint and slough at a given tensile strength than a web prepared with conventional softening agents or a combination of conventional softening agents and conventional strength agents.

Hence, in one aspect, the invention resides in a soft paper sheet, such as a tissue sheet, comprising a synthetic polymer having hydrogen bonding capability and containing a hydrophobic aliphatic hydrocarbon moiety, said polymer having the following structure:

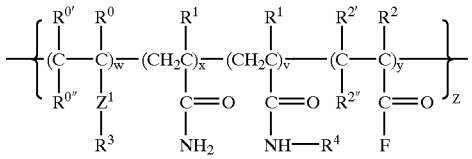

where:

w, x, y, z≧1;

v≧0;

$R^0$, $R^{0'}$, $R^{0''}$, $R^1$, $R^2$, $R^{2'}$, $R^{2''}$ are independently H, $C_{1-4}$ alkyl;

$R^3$=a $C_4$ or higher linear or branched, saturated or unsaturated, substituted or unsubstituted hydrophobic aliphatic hydrocarbon moiety;

$Z^1$=a bridging radical whose purpose is to attach the $R^3$ moiety to the polymer backbone. Suitable $Z^1$ radicals include but are not limited to —COO—, —CONH—, —S—, —OCO—, —NHCO—, —O—, aryl, —$CH_2$—;

F=a salt of an ammonium cation. The purpose of the F group is to provide a cationic charge to the polymer.

Alternatively F may contain a tertiary amine group capable of being protonated, such that in an acidic environment, the group will possess a cationic charge and thereby be capable of being retained on the cellulose.

$R^4$=an aldehyde functional hydrocarbyl radical, including but not limited to —CHOHCHO or —$CHOHCH_2CH_2CHO$.

Diallyldimethylammonium chloride can be used for incorporating the cationic monomer into the synthetic polymer. When Diallyldimethylammonium chloride is used the synthetic polymer has the following structure:

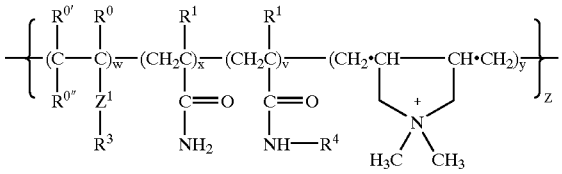

where $R^0$, $R^{0'}$, $R^{0''}$, $R^1$, $R^3$ $R^4$, $Z^1$, v, w, x, y, z are as defined above.

In another aspect, the invention resides in a method of making a soft, low lint paper sheet, such as a tissue sheet, comprising the steps of: (a) forming an aqueous suspension of papermaking fibers; (b) depositing the aqueous suspension of papermaking fibers onto a forming fabric to form a web; and (c) dewatering and drying the web to form a paper sheet, wherein a synthetic polymeric additive is added to the aqueous suspension of fibers or to the web, said polymeric additive having the following structure:

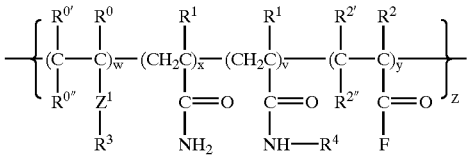

where:

w, x, y, z≧1;

v≧0;

$R^0$, $R^{0'}$, $R^{0''}$, $R^1$, $R^2$, $R^{2'}$, $R^{2''}$ are independently H, $C_{1-4}$ alkyl;

$R^3$=a $C_4$ or higher linear or branched, saturated or unsaturated, substituted or unsubstituted aliphatic hydrocarbon moiety;

$Z^1$=a bridging radical whose purpose is to attach the $R^3$ moiety to the polymer backbone. Suitable $Z^1$ radicals include but are not limited to —COO—, —CONH—, —S—, —OCO—, —NHCO—, —O—, aryl;

F=a salt of an ammonium cation. The purpose of the F group is to provide a cationic charge to the polymer. Alternatively F may contain a tertiary amine group capable of being protonated, such that in an acidic environment, said group will possess a cationic charge and thereby be capable of being retained on the cellulose; and $R^4$=an aldehyde functional hydrocarbyl radical, including but not limited to —CHOHCHO or $CHOHCH_2CH_2CHO$.

Diallyldimethylammonium chloride can be used to incorporate the cationic monomer into the synthetic polymer. When Diallyldimethylammonium chloride is used the synthetic polymer has the following structure:

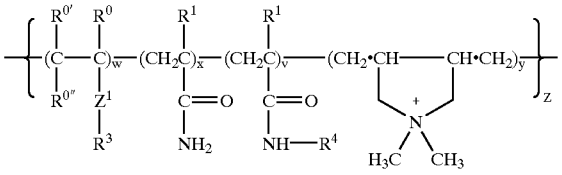

where $R^0$, $R^{0'}$, $R^{0''}$, $R^1$, $R^3$ $R^4$, $Z^1$, v, w, x, y, z are as defined above.

As used herein, "aliphatic hydrocarbon moieties" are functional groups derived from a broad group of organic compounds, including alkanes, alkenes, alkynes and cyclic aliphatic classifications. The aliphatic hydrocarbon moieties can be linear or branched, saturated or unsaturated, substituted or non-substituted.

The synthetic polymers as described herein may be water soluble, organic soluble or soluble in mixtures of water and water miscible organic compounds. Preferably they are water-soluble or water dispersible but this is not a necessity of the invention.

The amount of the synthetic polymeric additive added to the papermaking fibers or the paper or tissue web can be from about 0.02 to about 4 weight percent, on a dry fiber basis, more specifically from about 0.05 to about 3 weight percent, and still more specifically from about 0.1 to about 2 weight percent. The synthetic polymer can be added to the fibers or web at any point in the process, but it can be particularly advantageous to add the synthetic polymer to the fibers while the fibers are suspended in water. This can include, for example, addition in the pulp mill or to the pulper, a machine chest, the headbox or to the web prior to being dried where the consistency is less than about 80 percent.

DETAILED DESCRIPTION OF THE INVENTION

Figure 1:
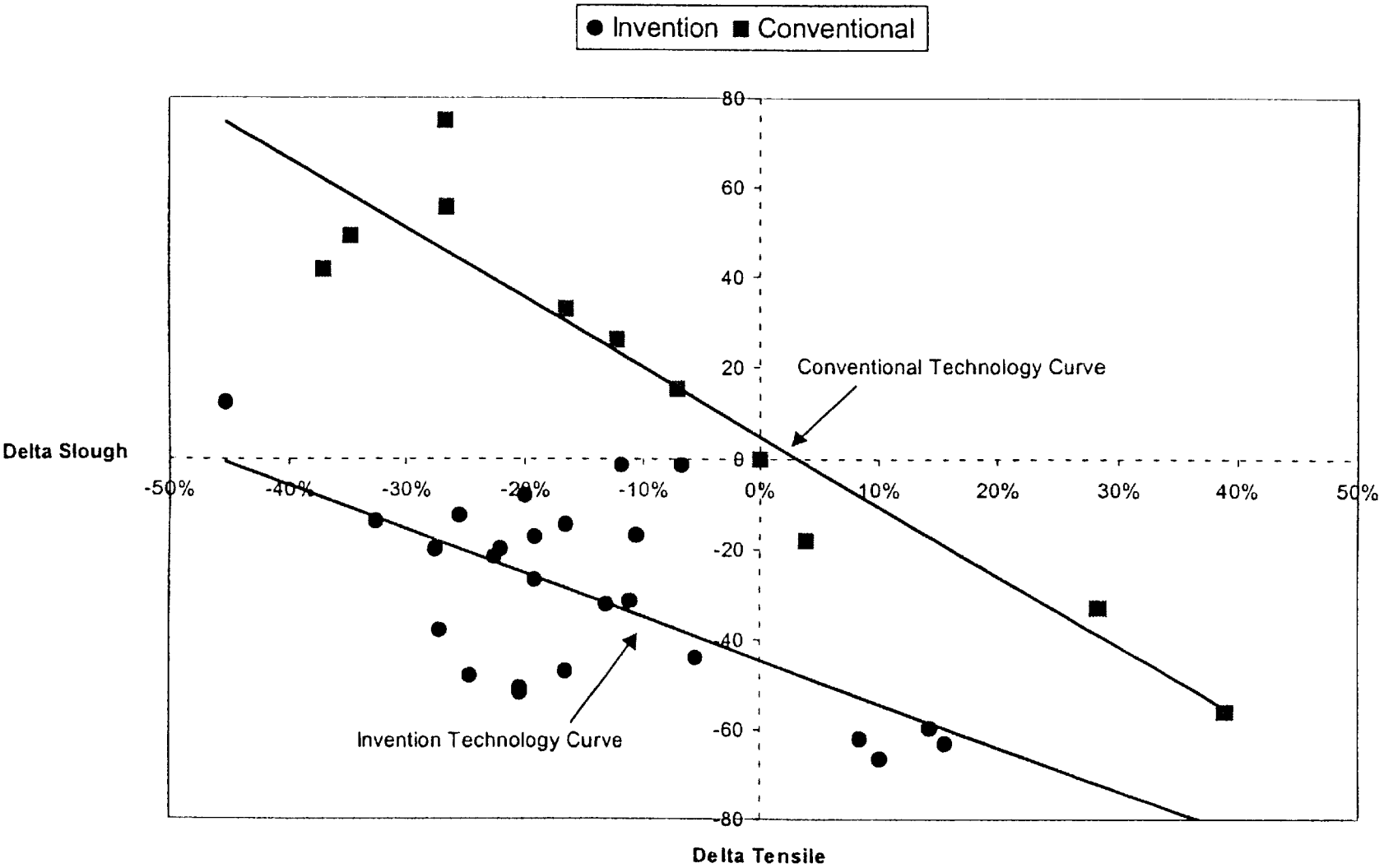
FIG. 1 is a plot of the change in slough as a function of the change in tensile strength taken from Examples 1–38.

To further describe the invention, examples of the synthesis of some of the various chemical species are given below.

Cationic polyacrylamides (PAMs) are widely used in the paper industry for a variety of applications including dry strength. Generally dry strength PAMs are supplied as ready to use aqueous solutions or as water-soluble powders which must be dissolved prior to use. They may be added to thin or thick stock at a point of good mixing for best results. Addition rates of 0.1% to 0.5% of dry fiber typically give best results. High addition rates may cause over-cationization of the furnish and reduce the effectiveness of other additives.

When used as dry strength additives usually around 5 mole % to 10 mole % of the monomers will contain charged groups. Cationic PAMs are effectively charged across the entire pH range. Typical molecular weights (Mw) for cationic PAM dry strength aids are in the range of 100,000 to 500,000. The molecular weight is important so as to be low enough to not bridge between particles and cause flocculation, and yet high enough to retard migration of the polymer into the pores of the fibers. Such migration would cause a reduction in dry strength activity.

When used as retention aids a broader range of molecular weights and charge densities may be employed. Key characteristics of polyacrylamide retention aids include the molecular weight, the type of charge, the charge density and the delivery form. For the average molecular weight, the range can be: low (1,000–100,000); medium (100,000–1,000,000); high (1,000,000–5,000,000); very high (>5,000,000). The charge type can be nonionic, cationic, anionic or amphoteric. The charge density can be: low (1–10%); medium (10–40%); high (40–80%); or very high (80–100%). The delivery form can be an emulsion, an aqueous solution or a dry solid.

High molecular weight/low charge density flocculents are used most often for retention of fine particles in high shear and turbulence environments. Low Mw, high charge density products are used for their charge modifying capabilities and for retention in low shear environments.

It is also well known that aldehyde functionality can easily be introduced into cationic polyacrylamides via reaction with a dialdehyde. For example, "glyoxylated" polyacrylamides are a class of charged polyacrylamides that has found widespread use in tissue and papermaking as temporary wet strength agents. U.S. Pat. No. 3,556,932 issued to Coscia et al., and assigned to the American Cyanamid Company, which is hereby incorporated by reference, describes the preparation and properties of glyoxylated polyacrylamides in detail. These polymers are ionic or nonionic water-soluble polyvinyl amides, having sufficient glyoxal substituents to be thermosetting. The minimum amount of pendant amide groups that need to be reacted with the glyoxal for the polymer to be thermosetting is around two mole percent of the total number of available amide groups. It is usually preferred to have an even higher degree of reaction so as to promote greater wet strength development, although above a certain level additional glyoxal provides only minimal wet strength improvement. The optimal ratio of glyoxylated to non-glyoxylated acrylamide groups is estimated to be around 10 to 20 mole percent of the total number of amide reactive groups available on the parent polymer. The reaction can be easily carried out in dilute solution by stirring the glyoxal with the polyacrylamide base polymer at temperatures of about 25° C. to 100° C. at a neutral or slightly alkaline pH. Generally the reaction is run until a slight increase in viscosity is noted. The majority of the glyoxal reacts at only one of its functionalities yielding the desired aldehyde functional acrylamide. It should also be noted that the reaction is not limited to glyoxal but may be accomplished with any water-soluble dialdehyde including glutaraldehyde. Examples of commercially available cationic glyoxylated polyacrylamides are Parez 631NC® manufactured and sold by Cytec, Inc. and Hercobond 1366® available from Hercules, Incorporated.

The molar and weight ratios of the various functional groups on the synthetic polymers of this invention will largely depend on the specific application of the material and is not a critical aspect of the invention. However, the acrylamide portion of the synthetic polymer capable of forming hydrogen bonds can constitute from about 5 to about 95 mole percent of the total polymer, more specifically from about 10 to about 90 mole percent of the total polymer and still more specifically from about 10 to about 80 mole percent of the total polymer. The aliphatic hydrocarbon portion of the synthetic polymer can constitute from about 0.5 to about 80 mole percent of the synthetic polymer, more specifically from about 2 to about 70 mole percent of the synthetic polymer and still more specifically from about 5 to about 60 mole percent of the synthetic polymer. The cationic charge containing portion of the synthetic polymer can be comprised of monomer units constituting from about 2 to about 70 mole percent of the total monomer units in the synthetic polymer, more specifically from 4 to about 50 mole percent and still more specifically from about 5 to about 25 mole percent.

The molecular weight of the synthetic polymers of the present invention will largely depend on the specific application of the material. The weight average molecular weight range can be from about 1,000 to about 8,000,000, more specifically from about 10,000 to about 4,000,000 and still more specifically from about 20,000 to about 2,000,000. Alkyl acrylates, methacrylates, acrylamides, methacrylamides, tiglates and crotonates, including octadecyl acrylate, octadecyl methacrylate, 2-ethylhexyl acrylate, 2-ethylhexyl methacrylate, 1-Ethylhexyl tiglate, n-butyl acrylate, t-butyl acrylate, butyl crotonate, butyl tiglate, dodecyl acrylate, dodecyl methacrylate, tridecyl acrylate, tridecyl methacrylate, lauryl acrylate, lauryl methacrylate , behenyl acrylate, sec-Butyl tiglate, Hexyl tiglate, Isobutyl tiglate, hexyl crotonate, butyl crotonate, n-butyl acrylamide, t-butyl acrylamide, N-(Butoxymethyl)acrylamide, N-(Isobutoxymethyl)acrylamide, and the like including mixtures of said monomers are known commercially available materials and are all suitable for incorporation of the aliphatic hydrocarbon moiety. Also known are various vinyl ethers including but not limited to n-butyl vinyl ether, 2-ethylhexyl vinyl ether, dodecyl vinyl ether, tridecyl vinyl ether, tetradecyl vinyl ether, pentadecyl vinyl ether, hexadecyl vinyl ether, and the corresponding esters including vinyl pivalate, vinyl butyrate, 4-(vinyloxy)butyl stearate, vinyl neodecanoate, vinyl neononaoate, vinyl stearate, vinyl 2-ethylhexanoate, vinyl dodecanoate, vinyl tetradecanoate, vinyl hexadecanoate and the like including mixtures of said monomers, all of which are suitable for incorporation of the aliphatic hydrocarbon moiety.

Also suitable for incorporation of the aliphatic hydrocarbon moiety are the α-unsaturated and β-unsaturated olefinic hydrocarbon derivatives such as 1-octadecene, 1-dodecene, 1-hexadecene, 1-heptadecene, 1-tridecene, 1-undecene, 1-decene, 1-pentadecene, 1tetradecene, 2-octadecene, 2-dodecene, 2-hexadecene, 2-heptadecene, 2-tridecene, 2-undecene, 2-decene, 2-pentadecene, 2-tetradecene, and the like including mixtures of said monomers. They can be incorporated into the directly into the polyacrylamide via copolymerization with acrylamide and the ethylenically unsaturated cationic monomer.

Suitable monomers for incorporating a cationic charge functionality into the polymer include, but are not limited to, [2-(methacryloyloxy)ethyl]trimethylammonium methosulfate (METAMS); dimethyldiallyl ammonium chloride (DMDAAC); 3-acryloamido-3-methyl butyl trimethyl ammonium chloride (AMBTAC); trimethylamino methacrylate; vinyl benzyl trimethyl ammonium chloride (VBTAC), 2-[(acryloyloxy)ethyl]trimethylammonium chloride, [2-(methacryloyloxy)ethyl]trimethylammonium chloride.

Analytical Methods

Basis Weight Determination (Handsheets)

The basis weight and bone dry basis weight of the specimens was determined using a modified TAPPI T410 procedure. "As is" basis weight samples are conditioned at 23° C.±1° C. and 50±2% relative humidity for a minimum of 4 hours. After conditioning, the handsheet specimen stack is cut to 7.5"×7.5" sample size. The number of handsheets in the stack (X) may vary but should contain a minimum of 5 handsheets. The specimen stack is then weighed to the nearest 0.001 gram on a tared analytical balance and the stack weight (W) recorded. The basis weight in grams per square meter is then calculated using the following equation:

$$\text{Actual Basis Weight (g/m}^2\text{)}=(W/X)\times 27.56$$

The bone-dry basis weight is obtained by weighing a sample can and lid to the nearest 0.001 grams (this weight is A). The sample stack is placed into the can and left uncovered. The uncovered sample can and stack along with can lid is placed in a 105° C.±2° C. oven for a period of 1 hour±5 minutes for sample stacks weighing less than 10 grams and at least 8 hours for sample stacks weighing 10 grams or greater. After the specified oven time the sample can lid is placed on the can and the can removed from the oven. The cans are allowed to cool to approximately ambient temperature but no more than 10 minutes. The can, cover and specimen are then weighed to the nearest 0.001 gram (this weight is C). The bone-dry basis weight in g/m$^2$ is calculated using the following equation:

$$\text{Bone Dry } BW \text{ (g/m}^2\text{)}=[(C-A)/X]\times 27.56$$

Dry Tensile Strength (Handsheets)

The tensile strength test results are expressed in terms of breaking length or alternatively in terms of peak load with units of (g/in.). Breaking length is defined as length of specimen that will break under its own weight when suspended and has units of km. It is calculated from the Peak Load tensile using the following equation:

$$\text{Breaking length (km)}=[\text{Peak Load in g/in}\times 0.039937]\div\text{Actual basis wt. in g/m}^2$$

Peak load tensile is defined as the maximum load, in grams, achieved before the specimen fails. It is expressed as grams-force per inch of sample width. All testing is done under laboratory conditions of 23.0+/−1.0 degrees Celsius, 50.0+/−2.0 percent relative humidity, and after the sheet has equilibrated to the testing conditions for a period of not less than four hours. Testing is done on a tensile testing machine maintaining a constant rate of elongation, and the width of each specimen tested was 1 inch. Sample strips are cut to a 1±0.004 inch width using a precision cutter. The "jaw span" or the distance between the jaws, sometimes referred to as gauge length, is 5.0 inches. Crosshead speed is 0.5 inches per minute (12.5 mm/min.) A load cell or full scale load is chosen so that all peak load results fall between 20 and 80 percent of the full scale load. Suitable tensile testing machines include those such as the Sintech QAD IMAP integrated testing system. This data system records at least 20 load and elongation points per second. A total of 5 specimens per sample are tested with the sample mean being used as the reported tensile value.

Basis Weight Determination (Tissue)

The basis weight and bone dry basis weight of the specimens was determined using a modified TAPPI T410 procedure. As is basis weight samples were conditioned at 23° C.±1° C. and 50±2% relative humidity for a minimum of 4 hours. After conditioning a stack of 16—3"×3" samples was cut using a die press and associated die. This represents a sample area of 144 in$^2$. Examples of suitable die presses are TMI DGD die press manufactured by Testing Machines, Inc. or a Swing Beam testing machine manufactured by USM Corporation. Die size tolerances are +/−0.008 inches in both directions. The specimen stack is then weighed to the nearest 0.001 gram on a tared analytical balance. The basis weight in pounds per 2880 ft$^2$ is then calculated using the following equation:

$$\text{Basis weight=stack wt. In grams/454*2880}$$

The bone dry basis weight is obtained by weighing a sample can and lid the nearest 0.001 grams (this weight is A). The sample stack is placed into the can and left uncovered. The uncovered sample can and stack along with can lid is placed in a 105° C.±2° C. oven for a period of 1 hour±5 minutes for sample stacks weighing less than 10 grams and at least 8 hours for sample stacks weighing 10 grams or greater. After the specified oven time the sample can lid is placed on the can and the can removed from the oven. The cans are allowed to cool to approximately ambient temperature but no more than 10 minutes. The can, cover and specimen are then weighed to the nearest 0.001 gram (this weight is C). The bone dry basis weight in pounds/2880 ft$^2$ is calculated using the following equation:

$$\text{Bone Dry } BW=(C-A)/454*2880$$

Dry Tensile (Tissue)

The Geometric Mean Tensile (GMT) strength test results are expressed as grams-force per 3 inches of sample width. GMT is computed from the peak load values of the MD (machine direction) and CD (cross-machine direction) tensile curves, which are obtained under laboratory conditions of 23.0+/−1.0 degrees Celsius, 50.0 +/- 2.0 percent relative humidity, and after the sheet has equilibrated to the testing conditions for a period of not less than four hours. Testing is done on a tensile testing machine maintaining a constant rate of elongation, and the width of each specimen tested was 3 inches. The "jaw span" or the distance between the jaws, sometimes referred to as gauge length, is 2.0 inches (50.8 mm). Crosshead speed is 10 inches per minute (254 mm/min.) A load cell or full-scale load is chosen so that all peak load results fall between 10 and 90 percent of the full-scale load. In particular, the results described herein were produced on an Instron 1122 tensile frame connected to a Sintech data acquisition and control system utilizing IMAP software running on a "486 Class" personal computer. This data system records at least 20 load and elongation points per second. A total of 10 specimens per sample are tested with the sample mean being used as the reported tensile value. The geometric mean tensile is calculated from the following equation:

$$GMT=(MD\text{ Tensile}*CD\text{ Tensile})^{1/2}$$

To account for small variations in basis weight, GMT values were then corrected to the 18.5#/2880 ft$^2$ target basis weight using the following equation:

$$\text{Corrected } GMT=\text{Measured } GMT*(18.5/\text{Bone Dry Basis Weight})$$

Lint and Slough Measurement

Figure 3:
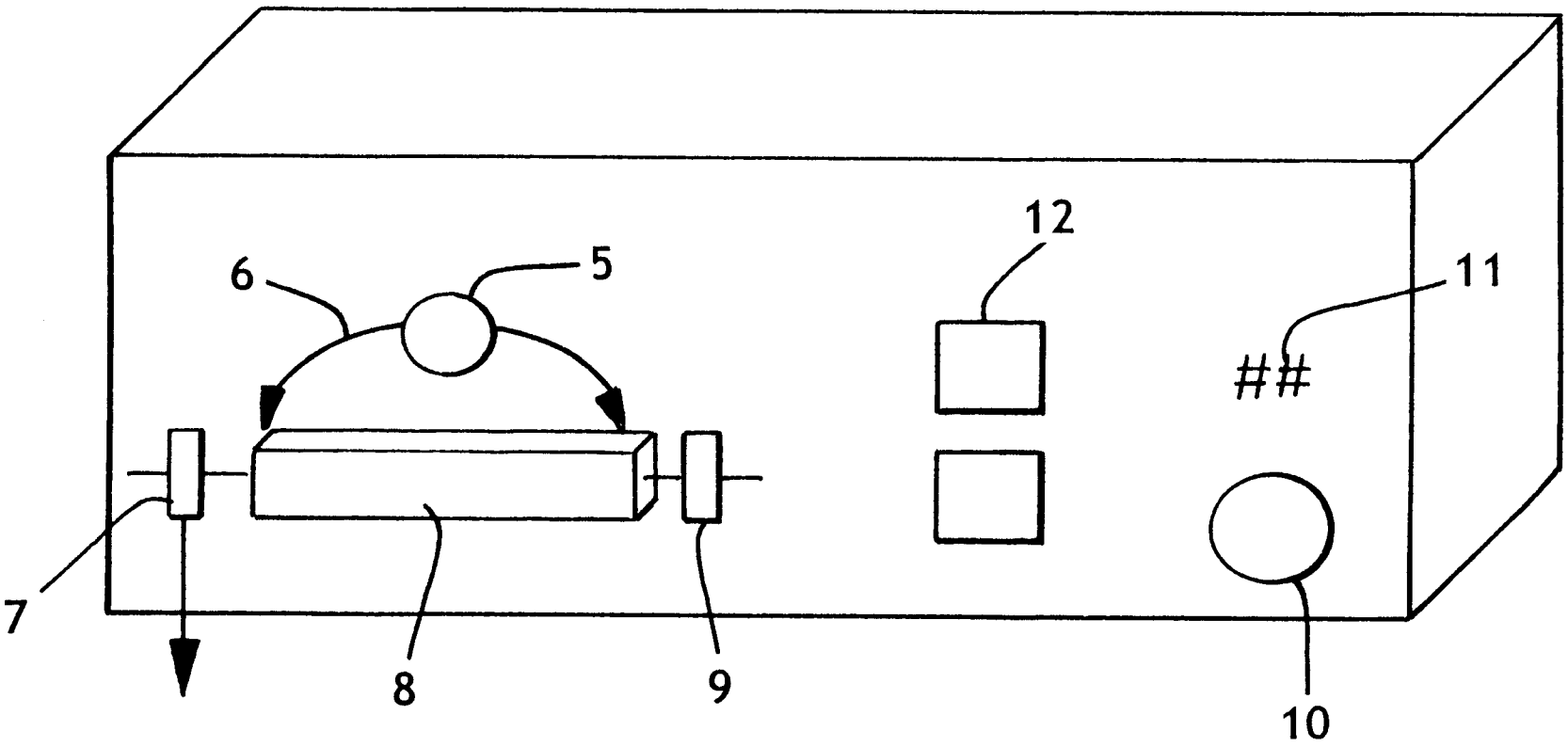
FIG. 3 is a schematic illustration of the test equipment used for measuring lint and slough.

In order to determine the abrasion resistance, or tendency of the fibers to be rubbed from the web when handled, each sample was measured by abrading the tissue specimens via the following method. This test measures the resistance of a material to an abrasive action when the material is subjected to a horizontally reciprocating surface abrader. The equipment and method used is similar to that described in U.S. Pat. No. 4,326,000, herein incorporated by reference. All samples were conditioned at 23° C.±1° C. and 50±2% relative humidity for a minimum of 4 hours. FIG. 3 is a schematic diagram of the test equipment. Shown is a mandrel 5, a double arrow 6 showing the motion of the mandrel, a sliding clamp 7, a slough tray 8, a stationary clamp 9, a cycle speed control 10, a counter 11, and start/stop controls 12.

The abrading spindle consists of a stainless steel rod, 0.5" in diameter with the abrasive portion consisting of a 0.005" deep diamond pattern knurl extending 4.25" in length around the entire circumference of the rod. The spindle is mounted perpendicularly to the face of the instrument such that the abrasive portion of the rod extends out its entire distance from the face of the instrument. On each side of the spindle is located a jaw, one movable and one fixed, spaced 4" apart and centered about the spindle. The movable jaw (approximately 102.7 grams) is allowed to slide freely in the vertical direction, the weight of the jaw providing the means for insuring a constant tension of the sample over the spindle surface.

Using a JDC-3 or equivalent precision cutter (Thwing-Albert Instrument Company, Philadelphia, Pa.) the specimens are cut into 3"±0.05" wide×7" long strips (note: length is not critical as long as specimen can span distance so as to be inserted into the jaws). For tissue samples, the MD direction corresponds to the longer dimension. Each test strip is weighed to the nearest 0.1 mg. One end of the tissue is clamped to the fixed jaw, the sample then loosely draped over the spindle and clamped into the movable jaw. The entire width of the tissue should be in contact with the abrading spindle. The movable jaw is then allowed to fall providing constant tension across the spindle.

The spindle is then moved back and forth at an approximate 15 degree angle from the centered vertical centerline in a reciprocal horizontal motion against the test strip for 20 cycles (each cycle is a back and forth stroke), at a speed of 170 cycles per minute, removing loose fibers from the web surface. Additionally the spindle rotates counter clockwise (when looking at the front of the instrument) at an approximate speed of 5 rpm. The sample is then removed from the jaws and any loose fibers on the sample surface are removed by gently shaking the sample test strip. The test sample is then weighed to the nearest 0.1 mg and the weight loss calculated. Ten test strips per sample are tested and the average weight loss value in mg recorded. The result for each example was compared with a control sample containing no chemicals. Where a 2-layered tissue is measured, placement of the sample should be such that the hardwood portion is against the abrading surface.

Softness

Softness is determined from sensory panel testing. The testing is performed by trained panelists who rub the formed tissue products and compare the softness attributes of the tissue to the same softness attributes of high and low softness control standards. After comparing these characteristics to the standards, the panelists assign a value for each of the tissue products' softness attributes. From these values an overall softness of the tissue product determined on a scale from 1—least soft to 16—most soft. The higher the number the softer the product. In general, a difference of less than 0.5 in the panel softness value is not statistically significant.

EXAMPLES

Examples 1–38

Examples 1–38 give a comparison of the slough/tensile performance for a variety of handsheets containing hydrophobically modified polyacrylamides against conventional handsheets containing no additives or modified with a traditional debonder and strength agent. Results are shown in Table 1. The polymers of the instant invention used in the examples in Table 1 have the structure shown below. The hydrophobic portion of the molecule can be built in either a block or random fashion as identified in Table 1. In all polymers, the cationic and acrylamide portions of the polymer are distributed in a random fashion. The weight average molecular weight of the polymers ranged from 500,000–4,000,000. All polymers contained 10 mole-% of 2-[(acryloyloxy)ethyl]trimethylammonium chloride as the source of the cationic charge so that y/(w+x+v+y)=0.1.

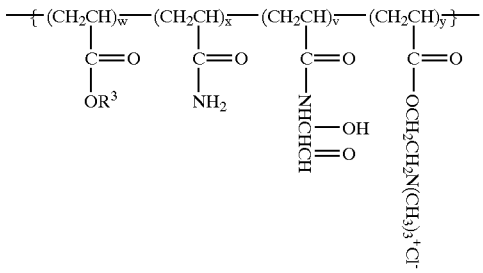

wherein, v, w, x, and y are the mole fractions of the individual component monomers of the polymer such that v+w+x+y=1.

Two different hydrophobe chain lengths were investigated. For a hydrophobe chain length of 8, $R^3$ is —CH$(C_2H_5)C_5H_{11}$ with the hydrophobic portion introduced into the polymer chain through co-polymerization with 2-ethylhexyl acrylate. For a hydrophobe chain length of 18, $R^3$ is —$CH_2(CH_2)_nCH_3$ where n=16 to 20 with the hydrophobic portion being introduced into the polymer chain through co-polymerization with a commercially available mixture of $C_{18}$ to $C_{22}$ acrylates.

Included within Table 1 are both glyoxylated (v>0) and non-glyoxylated versions (v=0) of the hydrophobically modified polyacrylamides. Such glyoxylated materials were made by reacting about 15% of the total number of available pendant amide groups of the hydrophobically modified polyacrylamide with glyoxal per methods known to those skilled in the art. Said polymers have a v/(x+v) ratio of about 0.15.

Handsheets were prepared in the following manner. About 15.78 g (15 grams o.d.b.) of northern softwood kraft and 37.03 g (35 grams o.d.b.) of eucalyptus were dispersed for 5 minutes in 2 liters of tap water using a British Pulp Disintegrator. The pulp slurry was then diluted to 8-liters with tap water. Solutions containing 0.5–1.0 wt. % of the hydrophobically modified cationic polyacrylamide were prepared. The hydrophobically modified cationic polyacrylamide co-polymer was then added to the pulp slurry in the appropriate amount and mixed for 15 minutes before being made into handsheets. The density of the polymer solutions is assumed to be 1 g/mL.

Handsheets were made with a basis weight of 60 gsm. During handsheet formation, the appropriate amount of fiber slurry required to make a 60 gsm sheet was measured into a graduated cylinder. The slurry was then poured from the graduated cylinder into a handsheet making mold apparatus, which had been pre-filled to the appropriate level with tap water. The fibers suspended in the handsheet mold water were then mixed using a perforated plate attached to a handle to uniformly disperse the fibers within the entire volume of the mold. After mixing, the sheet was formed by draining the water in the mold, thus depositing the fibers on the 90×90 mesh forming wire. The sheet was removed from the forming wire using blotters and a couch roll. The wet sheet was then transferred to a Valley Iron Works 8"×8" hydraulic press and pressed between two blotter sheets at 100 psi for 1 minute. After pressing, the sheet was transferred directly to a steam heated, convex surface metal dryer maintained at 213° F. (±2° F.). The sheet is held against the dryer by use of a canvas under tension. The sheet is allowed to dry for 2 minutes on the metal surface, and is then removed.

Handsheets were then conditioned and tested for tensile strength and slough per methods described previously. Results are shown in Table 1.

The control code had no chemicals added. Debonder codes were prepared using a commercially available oleyl imidazoline quaternary ammonium compound such as C-6027 manufactured and sold by Goldschmidt Chemical Corp. The debonder was added as a 1% emulsion to the pulp slurry and allowed to mix for 15 minutes prior to making the handsheets. A comparison is also made with material containing a temporary wet strength resin. The temporary wet strength resin used in the examples was Parez®631NC, a cationic glyoxylated polyacrylamide resin available from Cytec, Inc. The temporary wet strength resin was added as a 1% solids solution and added in the same manner as the hydrophobically modified polyacrylamides and debonder. Where both debonder and temporary wet strength resin were used, the debonder was added first to the slurry, then the temporary wet strength resin.

TABLE 1

| Example | Additive | Amount #/ton Dry Fiber | Hydrophobe Chain length | x | v | w | Structure | Break Length km | Slough mg | Delta Tensile | Delta Slough |
|---|---|---|---|---|---|---|---|---|---|---|---|
| 1 | Control | 0 | — | | — | — | — | 2.4 | 10.0 | 0% | 0% |
| 2 | Invention | 10 | 18–22 | 0.895 | 0 | 0.005 | random | 2.1 | 6.8 | −11% | −32% |
| 3 | Invention | 20 | 18–22 | 0.895 | 0 | 0.005 | random | 1.9 | 7.3 | −19% | −27% |
| 4 | Invention | 10 | 18–22 | 0.76 | 0.135 | 0.005 | random | 2.7 | 3.7 | 16% | −63% |
| 5 | Invention | 20 | 18–22 | 0.76 | 0.135 | 0.005 | random | 2.7 | 4.0 | 14% | −60% |
| 6 | Invention | 10 | 18–22 | 0.757 | 0.133 | 0.01 | random | 2.6 | 3.8 | 8% | −62% |
| 7 | Invention | 20 | 18–22 | 0.757 | 0.133 | 0.01 | random | 2.6 | 3.3 | 10% | −67% |
| 8 | Invention | 10 | 8 | 0.837 | 0 | 0.063 | block | 1.8 | 8.0 | −22% | −20% |
| 9 | Invention | 10 | 8 | 0.7 | 0 | 0.20 | block | 2.0 | 8.5 | −17% | −15% |
| 10 | Invention | 20 | 8 | 0.7 | 0 | 0.20 | block | 1.6 | 8.6 | −33% | −14% |
| 11 | Invention | 10 | 8 | 0.6 | 0 | 0.30 | block | 2.1 | 8.3 | −11% | −17% |
| 12 | Invention | 20 | 8 | 0.6 | 0 | 0.30 | block | 1.9 | 9.1 | −20% | −8% |
| 13 | Invention | 10 | 8 | 0.751 | 0.133 | 0.016 | block | 2.0 | 5.3 | −17% | −47% |
| 14 | Invention | 20 | 8 | 0.751 | 0.133 | 0.016 | block | 1.9 | 4.8 | −20% | −52% |
| 15 | Invention | 10 | 8 | 0.711 | 0.125 | 0.063 | block | 2.2 | 5.6 | −6% | −44% |
| 16 | Invention | 20 | 8 | 0.711 | 0.125 | 0.063 | block | 1.8 | 5.2 | −25% | −48% |
| 17 | Invention | 10 | 8 | 0.595 | 0.105 | 0.20 | block | 1.9 | 4.9 | −20% | −51% |
| 18 | Invention | 20 | 8 | 0.595 | 0.105 | 0.20 | block | 1.7 | 8.0 | −28% | −20% |
| 19 | Invention | 10 | 8 | 0.51 | 0.09 | 0.30 | block | 2.1 | 6.7 | −13% | −32% |
| 20 | Invention | 20 | 8 | 0.51 | 0.09 | 0.30 | block | 1.7 | 6.2 | −27% | −38% |
| 21 | Invention | 10 | 8 | 0.50 | 0 | 0.40 | block | 1.8 | 8.7 | −25% | −13% |
| 22 | Invention | 20 | 8 | 0.50 | 0 | 0.40 | block | 1.3 | 11.2 | −45% | 12% |
| 23 | Invention | 10 | 18 | 0.80 | 0 | 0.10 | block | 2.2 | 9.8 | −7% | −2% |
| 24 | Invention | 20 | 18 | 0.80 | 0 | 0.10 | block | 1.9 | 8.2 | −19% | −18% |
| 25 | Invention | 10 | 18 | 0.75 | 0 | 0.15 | random | 2.1 | 9.8 | −12% | −1% |
| 26 | Invention | 20 | 18 | 0.75 | 0 | 0.15 | random | 1.8 | 7.8 | −22% | −22% |
| 27 | Parez ® 631NC | 5 | — | | — | — | — | 3.0 | 6.7 | 28% | −33% |
| 28 | Parez ® 631NC | 10 | — | | — | — | — | 3.3 | 4.4 | 39% | −56% |
| 29 | C-6027 ® | 1 | — | | — | — | — | 2.2 | 11.5 | −7% | 15% |
| 30 | C-6027 | 2 | — | | — | — | — | 2.1 | 12.6 | −12% | 26% |
| 31 | C-6027 | 3 | — | | — | — | — | 1.7 | 15.5 | −27% | 56% |
| 32 | C-6027 | 5 | — | | — | — | — | 1.5 | 14.9 | −35% | 49% |
| 33 | C-6027 | 6 | — | | — | — | — | 1.5 | 14.1 | −37% | 42% |
| 34 | C-6027 Parez 631NC | 6 2 | — | | — | — | — | 1.7 | 17.5 | −27% | 75% |
| 35 | C-6027 Parez 631NC | 6 4 | — | | — | — | — | 2.0 | 13.3 | −17% | 33% |
| 36 | C-6027 Parez 631NC | 6 10 | — | | — | — | — | 2.5 | 8.3 | 4% | −17% |

Results are shown graphically in FIG. 1. It can clearly be seen in FIG. 1 that at a given tensile strength, the polymers of the instant invention give a product of lower slough than conventional methods employing a separate debonder and strength agent.

Examples 39–61

A one-ply, non-layered, uncreped throughdried tissue basesheet was made generally in accordance with U.S. Pat. No. 5,607,551 issued Mar. 4, 1997 to Farrington et al. entitled "Soft Tissue", which is herein incorporated by reference. More specifically, 65 pounds (oven dry basis) of eucalyptus hardwood kraft fiber and 35 pounds (oven dry basis) of northern softwood kraft fiber were dispersed in a pulper for 30 minutes at a consistency of 3 percent. The thick stock slurry was then passed to a machine chest and diluted to a consistency of 1 percent. To the machine chest was added the necessary amount of a hydrophobically modified cationic polyacrylamide containing 20 mole % 2-ethylhexyl acrylate, 70 mole % acrylamide and 10 mole % of [2-(acryloyloxy)ethyl] trimethylammonium chloride. The hydrophobic portion of the modified cationic polyacrylamide having a block structure with the acrylamide and cationic portions constituting a random structure. Low molecular weight polymers had an estimated molecular weight of approximately $1\times10^6$ based on 0.5% solution viscosity in water while the high molecular weight polymers had an estimated molecular weight of approximately $2.5\times10^6$ based on 0.5% solution viscosity in water.

Conventional codes were prepared using a commercially available oleyl imidazoline quaternary ammonium compound, C-6027® manufactured and sold by Goldschmidt Chemical Company. The debonder was added as a 1% emulsion directly to the machine chest and allowed to mix for 5 minutes prior to forming the sheet. The temporary wet strength resin used in the examples was Hercobond®-1366, a cationic glyoxylated polyacrylamide resin available from Hercules, Inc. The temporary wet strength resin was added as a 0.3% solids solution and was added in-line after the machine chest but before the fan pump. The stock was further diluted to approximately 0.1 percent consistency prior to forming. The formed web was non-compressively dewatered and rush transferred to a transfer fabric traveling at a speed about 25 percent slower than the forming fabric. The web was then transferred to a throughdrying fabric, dried. The total basis weight of the resulting sheet was 18.5 pounds per 2880 $ft^2$. Basesheet samples were then analyzed for tensile properties and slough. The basesheet was then calendered and selected products converted into standard bath product. The results are set forth in Table 2.

TABLE 2

| Example | Debonder Type | Glyoxylted PAM #/Ton | Debonder Addition Level #/ton | Polymer Mw | Adj GMT g/3-in | Slough mg | Delta Tensile % | Delta Slough % |
|---|---|---|---|---|---|---|---|---|
| 39 | none | — | — | — | 750 | 4.45 | 0.0 | 0.0 |
| 40 | Invention | 0 | 5 | Lo | 789 | 4.24 | 5.3 | −4.7 |
| 41 | Invention | 0 | 10 | Lo | 668 | 5.08 | −11.0 | 14.2 |
| 42 | Invention | 0 | 20 | Lo | 537 | 3.80 | −28.4 | −14.6 |
| 43 | Invention | 0 | 5 | Hi | 769 | 3.86 | 2.5 | −13.3 |
| 44 | Invention | 0 | 10 | Hi | 611 | 5.02 | −18.5 | 12.8 |
| 45 | Invention | 0 | 20 | Hi | 556 | 5.28 | −25.9 | 18.7 |
| 46 | Invention | 0 | 30 | Hi | 505 | 5.03 | −32.7 | 13.0 |
| 47 | Invention | 12.5 | 30 | Hi | 622 | 3.59 | −17.1 | −19.3 |
| 48 | C-6027 | 0 | 2 | 0 | 537 | 6.98 | −28.4 | 56.9 |
| 49 | C-6027 | 5 | 2 | 0 | 687 | 6.17 | −8.4 | 38.7 |
| 50 | C-6027 | 10 | 2 | 0 | 783 | 5.46 | 4.4 | 22.7 |
| 51 | C-6027 | 2 | 4 | 0 | 526 | 7.15 | −29.9 | 60.7 |
| 52 | C-6027 | 5 | 4 | 0 | 691 | 5.82 | −7.9 | 30.8 |
| 53 | C-6027 | 10 | 4 | 0 | 878 | 3.70 | 17.1 | −16.9 |
| 54 | C-6027 | 15 | 4 | 0 | 963 | 3.50 | 28.5 | −21.3 |
| 55 | C-6027 | 0 | 6 | 0 | 322 | 9.68 | −57.1 | 117.5 |
| 56 | C-6027 | 0 | 4 | 0 | 544 | 6.84 | −27.4 | 53.7 |
| 57 | C-6027 | 0 | 8 | 0 | 364 | 9.00 | −51.5 | 102.2 |
| 58 | C-6027 | 2 | 8 | 0 | 405 | 8.77 | −46.0 | 97.1 |
| 59 | C-6027 | 5 | 8 | 0 | 454 | 7.67 | −39.4 | 72.4 |
| 60 | C-6027 | 15 | 8 | 0 | 628 | 5.98 | −16.3 | 34.4 |
| 61 | none | 5 | 0 | 0 | 803 | 4.93 | 7.1 | 10.8 |

Figure 2:
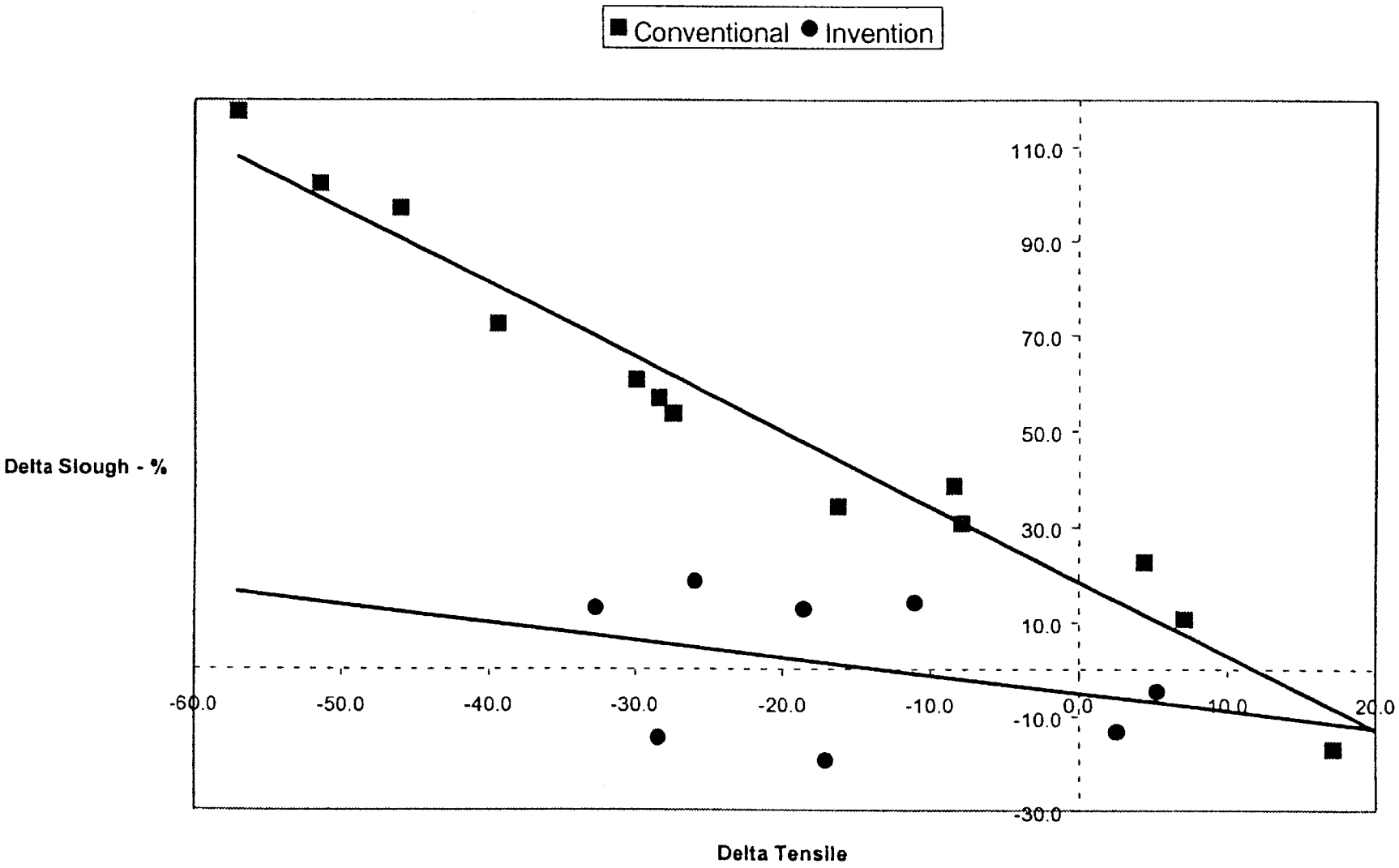
FIG. 2 is a plot of the change in slough as a function of the change in tensile strength taken from Examples 39–61.

Results are shown graphically in FIG. 2.

Sensory properties were then measured on the converted basesheet. Sensory data for the converted samples is summarized in Table 3.

TABLE 3

| Converted Tissue | | | |
|---|---|---|---|
| Example | Debonder | GMT | Panel Softness |
| 39 | Conventional | 670 | 12.1 |
| 42 | Invention | 480 | 13.3 |
| 43 | Invention | 739 | 12.1 |
| 44 | Invention | 574 | 13.0 |
| 45 | Invention | 511 | 13.4 |
| 49 | Conventional | 591 | 12.7 |
| 50 | Conventional | 689 | 12.5 |
| 52 | Conventional | 581 | 13.0 |

Examples 62–67

Examples 62–67 a one-ply, uncreped through air dried tissue was produced using a pilot tissue machine. The machine contains a 3 layer headbox, of which the outer layers contained the same furnish (75% eucalyptus, 25% broke) and the center layer was 100% softwood fiber. The resulting three-layered sheet structure was formed on a twin-wire, suction form roll, former. The speed of the forming fabrics was 2000 feet per minute (fpm). The newly-formed web was then dewatered to a consistency of about 27–29 percent using vacuum suction from below the forming fabric before being transferred to the transfer fabric, which was traveling 1600 feet per minute (25% rush transfer). A vacuum shoe pulling about 13.5 inches of mercury vacuum was used to transfer the web to the transfer fabric. The web was then transferred to a throughdrying fabric traveling at a speed of about 1600 fpm. The web was carried over a pair of Honeycomb throughdryers operating at supply air temperatures of about 390° F. and dried to final dryness of about 99 percent consistency. The air dry basis weight of the sheet was 34 gsm. The final fiber ratio in the sheet was 33% softwood fiber (in center layer) and 67% eucalyptus/broke (outer layers).

Examples 62–64

A 3-layer tissue sheet is prepared as described previously, using a conventional softener/debonder in the outer layers. The sheet is comprised of 33 weight percent in each layer. The center layer is made up of 100% bleached kraft softwood fibers, while the outer layers contain a blend of eucalyptus hardwood fibers and tissue broke.

The furnish used for the outer two layers comprise 75% eucalyptus fibers and 25% tissue broke. During the stock preparation phase, the outer layer furnish fibers were blended during repulping and placed in a stock chest at 3.5% consistency. The furnish was then treated with a softening/debonding agent, C-6027 from Goldschmidt Chemical Corp., at a dosage of 6.9 kg. of active chemical/metric ton of fiber. After 20 minutes of mixing time in the stock chest, the slurry was dewatered using a belt press to approximately 32% consistency. The filtrate from the dewatering process was sewered and not sent forward in the stock preparation or tissuemaking process. The thickened pulp was collected in crumb form into large bins for storage prior to tissuemaking.

At the time of manufacturing, the outer layer crumb pulp furnish, consisting of the chemically-treated eucalyptus/broke blend, was repulped in a hydrapulper. This repulped furnish was then sent to a machine chest. This machine chest then feeds the fan pumps for both outer layers of a three-layer tissue sheet.

The center layer furnish comprised 100% northern bleached softwood kraft fibers. This furnish was refined at a variable energy input of between 0–3 horsepower days/metric ton for dry strength development and control. Parez® 631NC (Cytec, Industries) was also added to this furnish at a dosage of 6 kg./metric ton to achieve wet tensile strength control.

Examples 65–67

For these examples, the hydrophobically modified polyacrylamide softening/debonding agent was used in place of the conventional debonder/softener described in Examples 62–64. The specific hydrophobically modified polyacrylamide had a Mw of about $1\times10^6$ and was comprised of 20 mole-% 2-ethylhexyl acrylate, 10 mole-% [2-(Acryoyloxy) ethyl]trimethylammonium chloride, and 70 mole-% acrylamide.

The furnish used for the outer two layers comprised 75% eucalyptus fibers, 25% tissue broke. During the stock preparation phase, the outer layer furnish fibers were blended during repulping and placed in a stock chest at 3.5% consistency. The furnish was then treated with the hydrophobically modified polyacrylamide softening/debonding agent, at a dosage of 9.1 kg. of active chemical/metric ton of fiber. After 20 minutes of mixing time in the stock chest, the slurry was dewatered using a belt press to approximately 32% consistency. The filtrate from the dewatering process was sewered and not sent forward in the stock preparation or tissuemaking process. The thickened pulp was collected in crumb form into large bins for storage prior to tissuemaking.

A one-ply, uncreped, through air dried tissue was made using a three layered headbox, as described in Examples 62–64. The furnish for the outer two layers, comprising the chemically treated 32% consistency eucalyptus/broke furnish blend, was repulped in a hydrapulper. This repulped furnish was then sent to a machine chest. Dry strength development was controlled by the addition of C-6027 debonder to the outer layer machine chest. This machine chest then feeds the fan pumps for both outer layers of a three-layer tissue sheet.

The center layer furnish comprised 100% northern bleached softwood kraft fibers. This furnish was not refined. Parez 631NC (Cytec Industries) was also added to this furnish at a dosage of 6 kg./metric ton to achieve wet tensile strength control.

The air dry basis weight of the sheet was 34 gsm. The final fiber ratio in the sheet was 33% softwood fiber (in center layer) and 67% eucalyptus/broke blend (outer layers). Three strength levels were produced by varying the C-6027 addition level to the outer layer machine chest.

Results are shown in Table 4 and clearly demonstrate the benefits of using the hydrophobically modified polyacrylamide.

TABLE 4

| Example | Refining HPD/MT | C-6027 kg/MT of Hardwood | Hydrophobically Modified PAM kg/MT of Hardwood. | GMT g/3" | Slough mg. |
|---|---|---|---|---|---|
| 62 | 0 | 6.9 | 0 | 544 | 8.91 |
| 63 | 1.5 | 6.9 | 0 | 714 | 8.38 |
| 64 | 3.0 | 6.9 | 0 | 955 | 7.14 |
| 65 | 0 | 0.7 | 9.1 | 571 | 7.78 |
| 66 | 0 | 0.2 | 9.1 | 695 | 6.86 |
| 67 | 0 | 0 | 9.1 | 806 | 4.86 |

It will be appreciated that the foregoing examples, given for purposes of illustration, are not to be construed as limiting the scope of this invention, which is defined by the following claims and all equivalents thereto.

We claim:

1. A soft tissue sheet comprising from about 0.05 to about 5 weight percent, based on the total weight of dry fiber in the sheet, of a synthetic polymer having hydrogen bonding capability and containing a hydrophobic aliphatic hydrocarbon moiety, said polymer having the following structure:

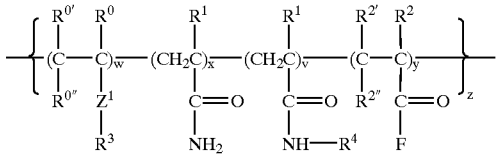

where;

w, x, y, z≧1;

v≧0;

$R^0$, $R^{0'}$, $R^{0''}$, $R^1$, $R^2$, $R^{2'}$, $R^{2''}$ are independently H or $C_{1-4}$ alkyl;

$R^3$=a $C_4$ or higher linear or branched, saturated or unsaturated, substituted or unsubstituted hydrophobic aliphatic hydrocarbon moiety;

$Z^1$=a bridging radical which attaches the $R^3$ moiety to the polymer backbone;

F=a quaternary ammonium salt; and $R^4$=an aldehyde functional hydrocarbyl radical.

2. The tissue sheet of claim 1 wherein $Z^1$ is selected from the group of radicals consisting of —COO—, —CONH—, —S—, —OCO—, —NHCO—, —O—, aryl, —N=CH—, and mixtures thereof.

3. The tissue sheet of claim 1 wherein F is —$Z^2$—$R^5$—$N^+R^6R^7R^8$, wherein:

$Z^2$=—O—, —NH—;

$R^5$=a saturated, linear or branched, hydrocarbon having a carbon chain length of 2 or more; and $R^6$, $R^7$, $R^8$ are independently $C_{1-18}$ alkyl.

4. The tissue sheet of claim 1 wherein v=0.

5. The tissue sheet of claim 1 wherein v>0.

6. The tissue sheet of claim 1 wherein the hydrophobic aliphatic hydrocarbon moiety portion constitutes from about 0.5 to about 50 mole percent of the total polymer.

7. The tissue sheet of claim 1 wherein the hydrophobic aliphatic hydrocarbon moiety constitutes from about 0.5 to about 50 mole percent of the total polymer and the moiety containing the cationic charge constitutes from about 2 to about 20 mole percent of the total polymer.

8. The tissue sheet of claim 1 wherein the hydrophobic aliphatic hydrocarbon moiety portion of the polymer constitutes from about 5 to about 30 mole percent of the total polymer.

9. The tissue sheet of claim 1 wherein $Z^1$=—COO— and $R^3$=—$CH(C_2H_5)C_5H_{11}$.

10. The tissue sheet of claim 1 wherein $Z^1$=—COO— and $R^3$=—$CH_2(CH_2)_nCH_3$ where n=18–22.

11. The tissue sheet of claim 1 wherein the hydrophobic aliphatic hydrocarbon moiety portion of the oco-polymer is incorporated as a block co-polymer.

12. The tissue sheet of claim 1 wherein the hydrophobic aliphatic hydrocarbon moiety portion of the co-polymer is incorporated in a random fashion.

13. The tissue sheet of claim 1 wherein the hydrophobically modified polymer has the following structure:

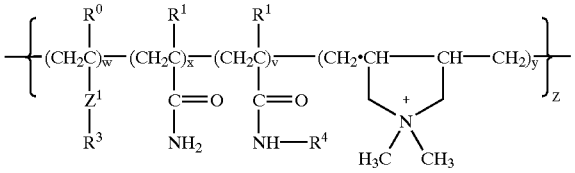

where:

w, x, y, z≧1;

v≧0;

$R^0$, $R^{0'}$, $R^{0''}$, $R^1$ are independently H or $C_{1-4}$ alkyl;

$R^3$=$C_4$ or higher linear or branched, saturated or unsaturated, substituted or unsubstituted hydrophobic aliphatic hydrocarbon moiety;

$Z^1$=a bridging radical which attaches the $R^3$ moiety to the polymer backbone; and $R^4$=an aldehyde functional hydrocarbyl radical.

14. The tissue sheet of claim 13 wherein $Z^1$ is selected from the group of radicals consisting of —COO—, —CONH—, —S—, —OCO—, —NHCO—, —O—, aryl, —N=CH—, and mixtures thereof.

15. The tissue sheet of claim 1 wherein the synthetic polymer is present in the range of from about 0.1% to about 3% by weight of total dry fiber.

16. The tissue sheet of claim 1 wherein the synthetic polymer is present in the range of from about 0.2% to about 2% by weight of total dry fiber.

17. The tissue sheet of claim 1 further comprising from about 0.01 to about 1.0% by weight of total dry fiber of a cationic debonder/softener.

18. The tissue sheet of claim 1 having two or more layers, wherein at least one of the layers is an outer layer containing predominantly hardwood fibers and wherein most of said synthetic polymer resides in the hardwood layer of the sheet.

19. A method of making a soft low lint, low slough paper sheet comprising the steps of:

(a) forming an aqueous suspension of papermaking fibers;

(b) depositing the aqueous suspension of papermaking fibers onto a forming fabric to form a web; and (c) dewatering and drying the web to form a paper sheet, wherein from about 0.05 to about 5 weight percent based on the total weight of dry fiber in the sheet, of a synthetic polymer is added to the aqueous suspension of fibers and/or the web, said synthetic polymer having hydrogen bonding capability and containing a hydrophobic aliphatic hydrocarbon moiety, said synthetic polymer having the following structure:

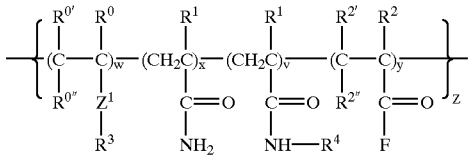

where:

w, x, y, z≧1;

v≧0;

$R^0$, $R^{0'}$, $R^{0''}$, $R^1$, $R^2$, $R^{2'}$, $R^{2''}$ are independently H or $C_{1-4}$ alkyl;

$R^3$=a $C_4$ or higher linear or branched, saturated or unsaturated, substituted or unsubstituted hydrophobic aliphatic hydrocarbon moiety;

$Z^1$=a bridging radical which attaches the $R^3$ moiety to the polymer backbone;

F=a quaternary ammonium salt which provides a cationic charge to the polymer; and $R^4$=an aldehyde functional hydrocarbyl radical.

20. The method of claim 19 wherein $Z^1$ is selected from the group of radicals consisting of —COO—, —CON—, —S—, —OCO—, —NHCO—, —O—, aryl, —N=CH— and mixtures thereof.

21. The method of claim 19 wherein F is —$Z^2$—$R^5$—$N^+R^6R^7R^8$ where:

$Z^2$=—O— or —NH—;

$R^5$=a saturated, linear or branched, hydrocarbon having a carbon chain length of 2 or more; and $R^6$, $R^7$, $R^8$ are independently $C_{1-18}$ alkyl.

22. The method of claim 19 wherein v=0.

23. The method of claim 19 wherein v>0.

24. The method of claim 19 wherein the hydrophobic aliphatic hydrocarbon moiety portion constitutes from about 0.5 to about 50 mole percent of the total polymer.

25. The method of claim 19 wherein the hydrophobic aliphatic hydrocarbon moiety portion of the polymer constitutes from about 5 to about 30 mole percent of the total polymer.

26. The paper sheet of claim 19 wherein $Z^1$=—COO— and $R^3$=—$CH(C_2H_5)C_5H_{11}$.

27. The paper sheet of claim 19 wherein $Z^1$=—COO— and $R^3$=—$CH_2(CH_2)_nCH_3$, where n=18–22.

28. The method of claim 19 wherein the hydrophobic aliphatic hydrocarbon moiety portion of the synthetic polymer is incorporated as a block co-polymer.

29. The method of claim 19 wherein the hydrophobic aliphatic hydrocarbon moiety portion of the synthetic polymer is incorporated in a random fashion.

30. The method of claim 19 wherein the synthetic polymer has the following structure:

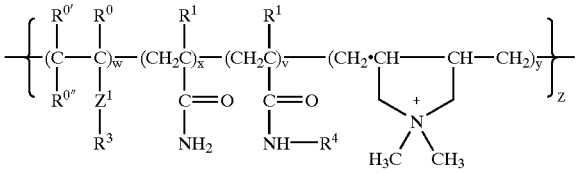

where:

w, x, y, z≧1;

v≧0;

$R^0$, $R^{0'}$, $R^{0''}$, $R^1$, $R^2$ are independently H or $C_{1-4}$ alkyl;

$R^3$=a linear or branched, saturated or unsaturated, substituted or unsubstituted hydrophobic aliphatic hydrocarbon moiety having a carbon chain length of 4 or more;

$Z^1$=a bridging radical which attaches the $R^3$ moiety to the polymer backbone; and $R^4$=an aldehyde functional hydrocarbyl radical.

31. The method of claim 30 wherein $Z^1$ is selected from the group of radicals consisting of —COO—, —CONH—, —S—, —OCO—, —NHCO—, —O—, aryl, —N=CH—, and mixtures thereof.

32. A soft tissue sheet comprising a synthetic polymer having hydrogen bonding capability and containing a hydrophobic aliphatic hydrocarbon moiety, said polymer having the following structure:

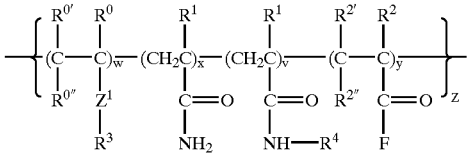

where:

w, x, y, z≧1;

v>0;

$R^0$, $R^{0'}$, $R^{0''}$, $R^1$, $R^2$, $R^{2'}$, $R^{2''}$ are independently H or $C_{1-4}$ alkyl;

$R^3$=a $C_4$ or higher linear or branched, saturated or unsaturated, substituted or unsubstituted hydrophobic aliphatic hydrocarbon moiety;

$Z^1$=a bridging radical which attaches the $R^3$ moiety to the polymer backbone;

F=a quaternary ammonium salt; and $R^4$=an aldehyde functional hydrocarbyl radical.

33. The tissue sheet of claim 32 wherein $Z^1$ is selected from the group of radicals consisting of —COO—, —CONH—, —S—, —OCO—, —NHCO—, —O—, aryl, —N=CH—, and mixtures thereof.

34. The tissue sheet of claim 32 wherein F is $—Z^2—R^5—N^+R^6R^7R^8$, wherein:

$Z^2$=—O—, —NH—;

$R^5$=a saturated, linear or branched, hydrocarbon having a carbon chain length of 2 or more; and $R^6$, $R^7$, $R^8$ are independently $C_{1-18}$ alkyl.

35. The tissue sheet of claim 32 wherein the hydrophobic aliphatic hydrocarbon moiety portion constitutes from about 0.5 to about 50 mole percent of the total polymer.

36. The tissue sheet of claim 32 wherein the hydrophobic aliphatic hydrocarbon moiety constitutes from about 0.5 to about 50 mole percent of the total polymer and the moiety containing the cationic charge constitutes from about 2 to about 20 mole percent of the total polymer.

37. The tissue sheet of claim 32 wherein the hydrophobic aliphatic hydrocarbon moiety portion of the polymer constitutes from about 5 to about 30 mole percent of the total polymer.

38. The tissue sheet of claim 32 wherein $Z^1$=—COO— and $R^3$=$—CH(C_2H_5)C_5H_{11}$.

39. The tissue sheet of claim 32 wherein $Z^1$=—COO— and $R^3$=$—CH_2(CH_2)_nCH_3$, where n=18–22.

40. The tissue sheet of claim 32 wherein the hydrophobic aliphatic hydrocarbon moiety portion of the co-polymer is incorporated as a block co-polymer.

41. The tissue sheet of claim 32 wherein the hydrophobic aliphatic hydrocarbon moiety portion of the co-polymer is incorporated in a random fashion.

42. The tissue sheet of claim 32 wherein the hydrophobically modified polymer has the following structure:

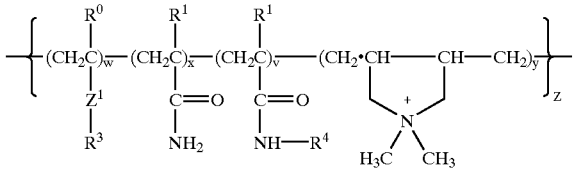

where:

w, x, y, z≧1;

v>0;

$R^0$, $R^{0'}$, $R^{0''}$, $R^1$ are independently H or $C_{1-4}$ alkyl;

$R^3$=$C_4$ or highs linear or branched, saturated or unsaturated, substituted or unsubstituted hydrophobic aliphatic hydrocarbon moiety;

$Z^1$=a bridging radical which attaches the $R^3$ moiety to the polymer backbone; and $R^4$=an aldehyde functional hydrocarbyl radical.

43. The tissue sheet of claim 42 wherein $Z^1$ is selected from the group of radicals consisting of —COO—,—CONH—, —S—, —OCO—, —NHCO—, —O—, aryl, —N=CH—, and mixtures thereof.

44. The tissue sheet of claim 42 wherein the synthetic polymer is present in the range of from about 0.05% to about 5% by weight of total fiber.

45. The tissue sheet of claim 32 wherein the synthetic polymer is present in the range of from about 0.1% to about 3% by weight of total dry fiber.

46. The tissue sheet of claim 32 wherein the synthetic polymer is present in the range of from about 0.2% to about 2% by weight of total dry fiber.

47. The tissue sheet of claim 32 further comprising from about 0.01 to about 1.0% by weight of total dry fiber of a cationic debonder/softener.

48. The tissue sheet of claim 32 having two or more layers, wherein at least one of the layers is an outer layer containing predominantly hardwood fibers and wherein most of said synthetic polymer resides in the hardwood layer of the sheet.

49. A method of making a soft low lint, low slough paper sheet comprising the steps of:

(a) forming an aqueous suspension of papermaking fibers;

(b) depositing the aqueous suspension of papermaking fibers onto a forming fabric to form a web; and (c) dewatering and drying the web to form a paper sheet, wherein a synthetic polymer is added to the aqueous suspension of fibers and/or the web, said synthetic polymer having hydrogen bonding capability and containing a hydrophobic aliphatic hydrocarbon moiety, said synthetic polymer having the following structure:

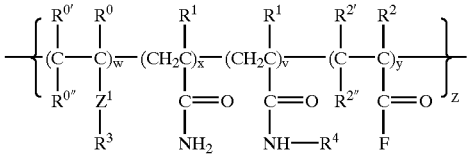

where:

w, x, y, z≧1:

v>0;

$R^0$, $R^{0'}$, $R^{0''}$, $R^1$, $R^2$, $R^{2'}$, $R^{2''}$ are independently H or $C_{1-4}$ alkyl;

$R^3$=a $C_4$ or higher linear or branched, saturated or unsaturated, substituted or unsubstituted hydrophobic aliphatic hydrocarbon moiety;

$Z^1$=a bridging radical which attaches the $R^3$ moiety to the polymer backbone;

F=a quaternary ammonium salt which provides a cationic charge to the polymer; and $R^4$=an aldehyde functional hydrocarbyl radical.

50. The method of claim 49 wherein $Z^1$ is selected from the group of radicals consisting of —COO—, —CONH—, —S—, —OCO—, —NHCO—, —O—, aryl, —N=CH— and mixtures thereof.

51. The method of claim 49 wherein F is $—Z^2—R^5—N^+R^6R^7R^8$ where:

$Z^2$=—O— or —NH—;

$R^5$=a saturated, linear or branched, hydrocarbon having a carbon chain length of 2 or more; and $R^6$, $R^7$, $R^8$ are independently $C_{1-18}$ alkyl.

52. The method of claim 49 wherein the hydrophobic aliphatic hydrocarbon moiety portion constitutes from about 0.5 to about 50 mole percent of the total polymer.

53. The method of claim 49 wherein the hydrophobic aliphatic hydrocarbon moiety portion of the polymer constitutes from about 5 to about 30 mole percent of the total polymer.

54. The method of claim 49 wherein $Z^1$=—COO— and $R^3$=$—CH(C_2H_5)C_5H_{11}$.

55. The method of claim 49 wherein $Z^1$=—COO— and $R^3$=$—CH_2(CH_2)_nCH_3$, where n=18–22.

56. The method of claim 49 wherein the hydrophobic aliphatic hydrocarbon moiety portion of the synthetic polymer is incorporated as a block co-polymer.

57. The method of claim 49 wherein the hydrophobic aliphatic hydrocarbon moiety portion of the synthetic polymer is incorporated in a random fashion.

58. The method of claim 49 wherein the synthetic polymer has the following structure:

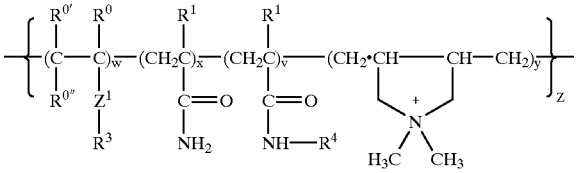

where:

w, x, y, z≧1;

v≧0;

$R^0$, $R^{0'}$, $R^{0''}$, $R^1$, $R^2$ are independently H or $C_{1-4}$ alkyl;

$R^3$=a linear or branched, saturated or unsaturated, substituted or unsubstituted hydrophobic aliphatic hydrocarbon moiety having a carbon chain length of 4 or more;

$Z^1$=a bridging radical which attaches the $R^3$ moiety to the polymer backbone; and $R^4$=an aldehyde functional hydrocarbyl radical.

59. The method of claim 58 wherein $Z^1$ is selected from the group of radicals consisting of —COO—, —CONH—, —S—, —OCO—, —NHCO—, —O—, aryl, —N=CH—, and mixtures thereof.

* * * * *